US006499444B1

(12) United States Patent
Batzill et al.

(10) Patent No.: US 6,499,444 B1
(45) Date of Patent: Dec. 31, 2002

(54) CYLINDER HEAD FOR A WATER-COOLED INTERNAL COMBUSTION ENGINE

(75) Inventors: Manfred Batzill, Neuhausen; Albrecht Reustle, Wahlheim, both of (DE)

(73) Assignee: Dr. Ing h.c.F. Porsche AG (DE)

( * ) Notice: Subject to any disclaimer, the term of this patent is extended or adjusted under 35 U.S.C. 154(b) by 0 days.

(21) Appl. No.: 09/659,037

(22) Filed: Sep. 11, 2000

(30) Foreign Application Priority Data

Sep. 9, 1999 (DE) ..... 199 43 001

(51) Int. Cl.[7] ..... F02F 1/36
(52) U.S. Cl. ..... 123/41.82 R
(58) Field of Search ..... 123/41.76, 41.77, 123/41.79, 41.82 R, 41.82 A

(56) References Cited

U.S. PATENT DOCUMENTS

| | | | | |
|---|---|---|---|---|
| 2,305,475 A | | 12/1942 | Jagersberger et al. | |
| 4,889,079 A | * | 12/1989 | Takeda et al. | 123/41.82 R |
| 5,379,729 A | * | 1/1995 | Yonezwa | 123/41.82 R |
| 5,799,627 A | | 9/1998 | Dohn et al. | 123/41.82 R |
| 5,890,461 A | | 4/1999 | Iikura | 123/41.82 R |
| 5,983,843 A | * | 11/1999 | Suzuki et al. | 123/41.82 R |

FOREIGN PATENT DOCUMENTS

| | | |
|---|---|---|
| DE | 1064289 | 8/1959 |
| DE | 2037315 | 2/1972 |
| DE | 3802886 | 8/1988 |
| DE | 19508113 | 9/1996 |
| DE | 19644409 | 2/1998 |
| EP | 088 157 A1 | 9/1983 |
| EP | 3412052 C2 | 10/1985 |
| EP | 353 988 A1 | 2/1990 |
| FR | 1006447 | 4/1952 |
| GB | 583652 | 12/1946 |
| GB | 706974 | 4/1954 |
| GB | 766187 | 1/1957 |

* cited by examiner

*Primary Examiner*—Noah P. Kamen
(74) *Attorney, Agent, or Firm*—Crowell & Moring LLP

(57) ABSTRACT

A combustion engine cylinder head has at one wall of the cylinder head at least one hot site produced by the radiant heat of a combustion space. The hot site is cooled by a cooling duct, through which cooling water is flowing. To optimize the cooling of the hot site, an additional flow channel is provided, for a concerted flow of cooling water and for carrying additional cooling water in the cooling duct and for cooling of the hot site in the wall of the cylinder head.

13 Claims, 2 Drawing Sheets

CYLINDER HEAD FOR A WATER-COOLED INTERNAL COMBUSTION ENGINE

BACKGROUND AND SUMMARY OF THE INVENTION

This application claims the priority of German Patent Document 199 43 001.2, filed Sep. 9, 1999, the disclosures of which is expressly incorporated by reference herein.

The invention relates to a cylinder head for a water-cooled internal combustion engine which in use has at least one hot site caused by radiant heat of a combustion space at a wall of the cylinder head, which hot site is cooled by a cooling duct through which cooling water is flowing.

A cylinder head for a valve-controlled internal combustion engine with water cooling is known from European Patent Document EP 0088 157 A 1 and comprises cylinder head measures for decreasing thermal loads. For this purpose, a nozzle-like main water crossing is provided, which produces a flow acting between exhaust and refill ducts.

In FIG. 3, European Patent Document EP 0353988 A1 shows a cylinder head, which is water cooled and has a hot site in the region of one wall of the cylinder head. The hot site extends between a central spark plug and a combustion space.

U.S. Pat. No. 2,305,457 deals with a water-cooled cylinder head with cooling ducts extending around exhaust valves. These cooling ducts, in the vicinity of the exhaust valves, have walls which are cooled by means of a cooling medium distributed over spray nozzles.

Finally, German Patent Document DE 3412 052 C2 is concerned with a cylinder head which is provided with valves that are surrounded by valve-seat rings. These valve-seat rings are bounded by annular ducts which carry the cooling water.

It is an object of the invention to configure a cooling duct of a cylinder head of an internal combustion engine in such a manner that, in particular, pronounced hot sites of the cylinder head are cooled with flowing cooling water.

Pursuant to the invention, this objective is accomplished by providing a cylinder head for a water-cooled internal combustion engine which in use has at least one hot site brought about by radiant heat of a combustion space at a wall of the cylinder head, which hot site is cooled by means of a cooling duct through which cooling water is flowing, wherein flow structure carrying additional cooling water is provided in the cooling duct for a concerted flow of cooling water and for cooling the hot site at the wall of the cylinder head.

The following description and the claims describe advantageous features of preferred embodiments of the invention.

Advantages achieved with the invention are that the flow measures carrying additional cooling water bring about a concerted flow of cooling water and cooling in the region of the hot site, that is, at the wall of the cooling duct, which extends, for example, between the central spark plug and a combustion space. The flow measures are particularly effective if they are formed by one or more additional ducts, at least one additional duct being directed onto the hot site. This additional duct is connected with a duct supplying cooling water which is provided in a cylinder housing mounted at the cylinder head. Moreover, in addition to the flow measures, one or more control measures are disposed in the cooling duct and likewise ensure a concerted flow of cooling water and cooling of the hot site at the wall of the cylinder head. The flow measures and the control measures bring about a concerted flow of the cooling water to the hot site and thus reduce the risk of a temperature-induced excessive stress. In turn, this makes it possible, on the one hand, to use standard materials (AlSi 10 and AlSi 7) for the structural design of the cylinder head and, on the other, to reduce clearly the number of defective units, which are particularly costly especially in the case of cylinder heads of internal combustion engines.

Other objects, advantages and novel features of the present invention will become apparent from the following detailed description of the invention when considered in conjunction with the accompanying drawings.

DETAILED DESCRIPTION OF THE DRAWINGS

Figure 1:
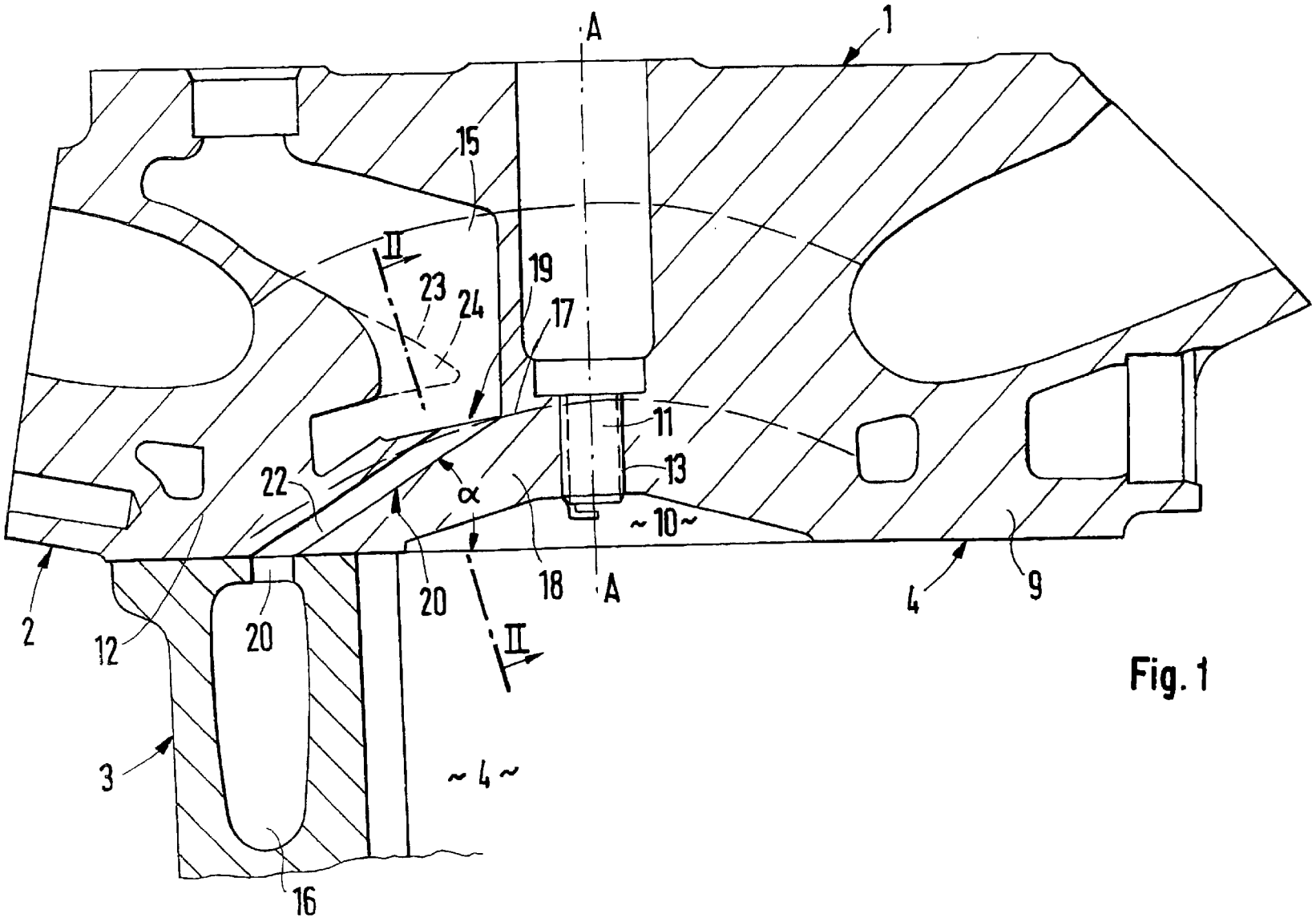
FIG. 1 shows a cross-section of an internal combustion engine in the region of a cylinder head and a cylinder housing, constructed according to preferred embodiments of the invention.
Figure 2:
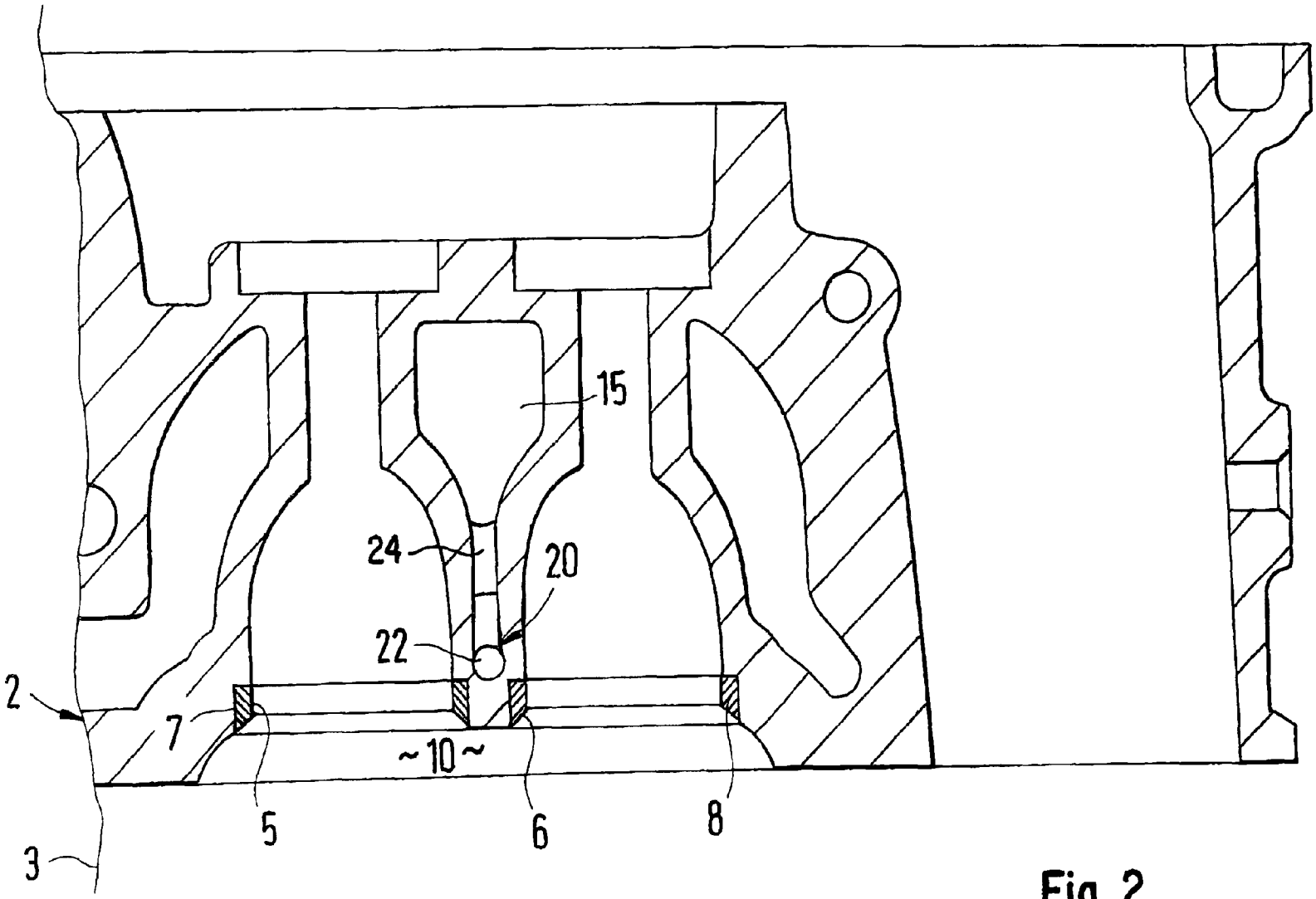
FIG. 2 shows a section along the line II—II of FIG. 1.

In the region shown, a multi-cylinder internal combustion spark-ignition engine 1 with carburetor and water cooling which is suitable for installation in a motor vehicle, comprises a cylinder head 2 and a cylinder housing 3, which consist of a light metal alloy and are assembled in a parting plane 4. Per cylinder, the cylinder head 2 is provided with two intake valves and two exhaust valves (not shown). The exhaust valves interact with valve seat rings 5, 6, which rest in respective valve seats 7, 8 (FIG. 2).

A fuel-air mixture is supplied over the intake valves of an intake side 9 by manifold injection to a combustion space 10 and ignited by means of a spark plug 11, after which it passes through the exhaust valves of an exhaust side 12 in the form of exhaust gases and reaches the exhaust equipment, which is not shown. The spark plug 11, which is screwed into a threaded borehole 13 of the cylinder head, extends in a central longitudinal plane A—A of a cylinder 14 or, at a slight distance therefrom, that is, it occupies a central position in the combustion space 10.

In the cylinder head 2, which is cooled with cooling water, a cooling duct 15 is provided for each combustion space 10 or for each cylinder 14. The cooling duct 15 is supplied with said cooling water from a cooling water-supplying duct 16 of the cylinder housing 3. The cooling water flows from the exhaust side 12 from the cooling water-supplying duct 16 over the cooling duct to the intake side 9—cooling duct 15 bringing about a transverse flow in the cylinder head 2—and is discharged through a cooling water-discharging duct (not shown) in the cylinder head 2.

During the operation of the internal combustion engine 1, a hot site 17 develops due to radiant heat of the combustion space 10 in the cooling duct 15 at a wall 18, which forms the boundary of the threaded borehole 13 and of the combustion space 10. In order to ensure concerted cooling of this hot site 17, additional control measures 19, carrying cooling water, are provided in the cooling duct 15. The flow measures 19 comprise an additional duct 20, over which a defined jet of cooling water reaches the hot site 17, so that the thermal stress on the wall 18 of the cylinder head 2 is reduced. In the embodiment shown, the additional channel 20 is directed approximately onto the hot site 17 and connected over a borehole 22 with the cooling water-supplying duct 16 in the cylinder housing. For manufacturing reasons, the additional duct 20 is constructed as an oblique borehole 22, which extends at an angle to the parting plane 4 between the cooling water—supplying duct 20 of the cylinder housing 3 and the cooling duct 15 in the cylinder head 2. In addition, the additional duct 20 is disposed so that it extends between the exhaust valves and, moreover, in the vicinity of the valve seats 7, 8 or the valve seat rings 5, 6, as a result of which an additional cooling effect is achieved at the latter.

Finally, in addition to the flow measures 19, control measures 23 are also incorporated within the cooling duct 15. The control measures 23 also serve to produce a concerted flow of cooling water to cool the hot site 17 at the wall 18 of the cylinder head 2. The control measures 23 are formed by one or more guiding ribs 24, which bring about a defined accelerated flow of cooling water.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cylinder head for a water-cooled internal combustion engine which in use has at least one hot site brought about by radiant heat of a combustion space at a wall of the cylinder head, which hot site is cooled by means of a cylinder head cooling duct through which cooling water is flowing, wherein flow structure carrying additional cooling water is provided for the cylinder head cooling duct for a concerted flow of cooling water and for cooling the hot site at the wall of the cylinder head, wherein the hot site is located at a wall section of the cylinder head that borders a combustion chamber space and a threaded bore of a spark plug, wherein the flow structure comprises at least one additional duct which supports the flow of cooling water in the region of the hot site, and wherein at least one further control structure for a concerted flow of cooling water and for cooling the hot site at the wall of the cylinder head are provided within the cooling duct in addition to the at least one additional duct, wherein the control structure includes at least one guiding rib in the cylinder head cooling duct and disposed adjacent to the wall section defining the hot site and wherein the guiding rib extends from a side wall that defines the cooling duct and extends substantially parallel to a bottom wall that defines the cooling duct.

2. The cylinder head of claim 1, wherein the at least one additional duct is aligned approximately onto the hot site.

3. The cylinder head of claim 2, with at least two exhaust valves per cylinder, which have valve seats and are cooled by the cylinder head cooling duct, the cooling water being guided with formation of a transverse flow acting from an exhaust side to an intake side of the cylinder head, and wherein the at least one additional duct extends between the exhaust valves in the vicinity of valve seats of the exhaust valves.

4. The cylinder head of claim 1, with at least two exhaust valves per cylinder, which have valve seats and are cooled by the cylinder head cooling duct, the cooling water being guided with formation of a transverse flow acting from an exhaust side to an intake side of the cylinder head, and wherein the at least one additional duct extends between the exhaust valves in the vicinity of valve seats of the exhaust valves.

5. The cylinder head of claim 1, wherein the at least one additional duct is connected with a cooling water-supplying duct.

6. The cylinder head of claim 5, wherein the cooling water-supplying duct is provided in a cylinder housing which is mounted at the cylinder head.

7. The cylinder head of claim 6, wherein the at least one additional duct is constructed as an oblique borehole between the cooling water-supplying duct of the cylinder housing and the cylinder head cooling duct.

8. The cylinder head of claim 5, with at least two exhaust valves per cylinder, which have valve seats and are cooled by the cylinder head cooling duct, the cooling water being guided with formation of a transverse flow acting from an exhaust side to an intake side of the cylinder head, and wherein the at least one additional duct extends between the exhaust valves in the vicinity of valve seats of the exhaust valves.

9. The cylinder head of claim 6, with at least two exhaust valves per cylinder, which have valve seats and are cooled by the cylinder head cooling duct, the cooling water being guided with formation of a transverse flow acting from an exhaust side to an intake side of the cylinder head, and wherein the at least one additional duct extends between the exhaust valves in the vicinity of valve seats of the exhaust valves.

10. The cylinder head of claim 7, with at least two exhaust valves per cylinder, which have valve seats and are cooled by the cylinder head cooling duct, the cooling water being guided with formation of a transverse flow acting from an exhaust side to an intake side of the cylinder head, and wherein the at least one additional duct extends between the exhaust valves in the vicinity of valve seats of the exhaust valves.

11. An internal combustion engine assembly comprising:

a cylinder housing, a cylinder head connected to the housing, a spark plug disposed in the cylinder head in a position central to a cylinder opening of the cylinder housing, a pair of outlet valves disposed in the cylinder head facing the cylinder opening, a coolant duct in the cylinder head, an additional coolant duct extending from the cylinder housing into the cylinder head to a position in the coolant duct operable to supply additional flowing coolant at a hot site, wherein the hot site is located at a wall section of the cylinder head that borders a combustion chamber space and a threaded bore of a spark plug, and further control structure in the coolant duct which is separate from the additional coolant duct and is operable for directing flow of coolant in the coolant duct to the hot site, wherein the control structure includes at least one guiding rib in the cylinder head coolant duct and disposed adjacent to the wall section defining the hot site and wherein the guiding rib extends from a side wall that defines the coolant duct and extends substantially parallel to a bottom wall that defines the coolant duct.

12. An engine assembly according to claim 11, wherein the at least one additional duct is constructed as an oblique borehole between the cooling water-supplying duct of the cylinder housing and the cooling duct in the cylinder head.

13. An engine assembly according to claim 12, wherein the bore opens between the exhaust valves.

* * * * *